US009746182B2

(12) United States Patent
Blalock et al.

(10) Patent No.: US 9,746,182 B2
(45) Date of Patent: Aug. 29, 2017

(54) HOME COOKING APPLIANCE WITH AN ELECTRODE CHAMBER

(71) Applicant: BSH Home Appliances Corporation, Irvine, CA (US)

(72) Inventors: Edward Blalock, Jacksboro, TN (US); John Freeman, Knoxville, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 433 days.

(21) Appl. No.: 13/923,462

(22) Filed: Jun. 21, 2013

(65) Prior Publication Data

US 2014/0377711 A1 Dec. 25, 2014

(51) Int. Cl.

| | |
|---|---|
| ***F23Q 7/06*** | (2006.01) |
| ***F23Q 3/00*** | (2006.01) |
| ***F24C 3/10*** | (2006.01) |

(52) U.S. Cl.

CPC ..... *F23Q 3/006* (2013.01); *F24C 3/103* (2013.01)

(58) Field of Classification Search

CPC .. F24C 3/10; F24C 3/103; F24C 3/082; F24C 3/087; F24C 3/122; F24C 7/08; F24C 14/025; F24C 15/00; F24C 15/006; F24C 15/008; F24C 15/02; F24C 15/105; F24C 15/106; F24C 15/108; F24C 15/14; F24C 15/16; F24C 15/18

See application file for complete search history.

(56) References Cited

U.S. PATENT DOCUMENTS

| | | | | |
|---|---|---|---|---|
| 492,685 | A * | 2/1893 | Jolly | F24C 3/10 431/270 |
| 1,088,911 | A * | 3/1914 | Leavitt | F24C 3/10 431/270 |
| 2,921,239 | A * | 1/1960 | Dryden | F23Q 3/006 313/131 R |
| 3,265,114 | A | 8/1966 | Childree | |
| 3,271,624 | A * | 9/1966 | Kingma | F23Q 3/002 123/642 |
| 4,288,210 | A | 9/1981 | Leonard et al. | |
| 4,337,029 | A | 6/1982 | McElroy et al. | |

(Continued)

FOREIGN PATENT DOCUMENTS

| | | | | |
|---|---|---|---|---|
| CN | 2605477 Y | 3/2004 | | |
| ES | WO 2009098117 A1 * | 8/2009 | | F23Q 3/008 |

*Primary Examiner* — Jason Lau

(74) *Attorney, Agent, or Firm* — Michael E. Tschupp; Andre Pallapies

(57) ABSTRACT

A home cooking appliance having an electrode chamber for a burner assembly is provided. The home cooking appliance includes a burner rail, maintop surface, burner assembly including a burner electrode, igniter box below the burner rail and maintop surface, and an electrode chamber on the burner rail. The electrode chamber includes a body having a cavity and a first opening at a first end of the body, wherein a portion of the burner electrode is disposed in the cavity, an electrical contact surface in the cavity that engages and electrically connects the electrical contact surface to the portion of the burner electrode, and an electrical connector at a second end of the body, the electrical connector being electrically connected to the electrical contact surface and to the igniter box, thereby electrically connecting the igniter box to the portion of the burner electrode.

32 Claims, 13 Drawing Sheets

(56) References Cited

U.S. PATENT DOCUMENTS

| | | | | | |
|---|---|---|---|---|---|
| 4,604,049 | A * | 8/1986 | Katchka | F23D 14/725 | 431/350 |
| 5,283,499 | A * | 2/1994 | Adam | H01R 13/2421 | 123/169 R |
| 5,468,145 | A | 11/1995 | Ferlin | | |
| 5,836,756 | A * | 11/1998 | Moss | F23Q 3/008 | 126/41 R |
| 5,924,860 | A * | 7/1999 | Massey | F23D 14/06 | 126/39 E |
| 6,012,443 | A * | 1/2000 | Peug | F24C 3/103 | 126/39 E |
| 6,015,322 | A * | 1/2000 | White | F23Q 3/008 | 264/618 |
| 7,201,613 | B2 * | 4/2007 | Sasaki | H01R 13/2421 | 439/700 |
| 8,171,927 | B2 * | 5/2012 | Pryor | F23D 14/06 | 126/39 E |
| 2002/0034713 | A1 * | 3/2002 | Harneit | F23D 14/06 | 431/266 |
| 2003/0034425 | A1 * | 2/2003 | Hueser | F24C 3/103 | 248/229.16 |
| 2007/0131217 | A1 * | 6/2007 | Chung | F24C 3/103 | 126/25 R |
| 2009/0098495 | A1 | 4/2009 | Pianezze | | |
| 2011/0129783 | A1 * | 6/2011 | Harneit | F23D 14/06 | 431/144 |
| 2011/0207065 | A1 * | 8/2011 | Shaffer | F24C 3/103 | 431/73 |
| 2012/0282560 | A1 * | 11/2012 | Cadima | F23Q 3/008 | 431/258 |

* cited by examiner

500

500

HOME COOKING APPLIANCE WITH AN ELECTRODE CHAMBER

FIELD OF THE INVENTION

The present invention is directed to a home cooking appliance, and more particularly, to a home cooking appliance with an electrode chamber connecting a burner electrode to an igniter box of the home cooking appliance without routing an igniter wire through the rangetop maintop and rail.

BACKGROUND OF THE INVENTION

A conventional home cooking appliance, such as a range or cooktop 100, is illustrated in FIGS. 1-5. A conventional home cooking appliance can include a plurality of gas burners 102 on a rangetop maintop 104 of the appliance 100. Each of the plurality of burners 102 can include, for example, a burner pedestal 106, a burner body 108, a burner head 110, and a burner electrode 112 for igniting the gas supplied to the burner 102. The burner electrode 112 is mounted in the burner 102 above the rangetop maintop 104 (e.g., a spill tray) and must be electrically connected to an igniter box (200 shown for example in FIGS. 4 and 5), which is located below the rangetop maintop 104 (e.g., on a rangetop floor 131).

An example of a conventional burner 102 without the burner head in place is illustrated in FIG. 2. The burner 102 can include a burner pedestal 106, a burner body 108, a burner electrode 112, and a venture tube 122 extending upward from a gas outlet 124 below or within the burner to the top of the burner 102. With reference again to FIG. 2 and also FIG. 3, a conventional burner electrode 112 can include a body 114 having a mounting bracket 116, an igniter 118, and an electrical connector 120 for connecting the burner electrode 112 to the igniter box (200 shown in FIGS. 4 and 5).

As shown in the conventional arrangement illustrated in FIGS. 4 and 5, a spark igniter wire 300 must be provided to connect the igniter box 200 to the electrical connector 120 (shown in FIG. 3) on the lower end of the burner electrode 112 to transfer the ignition spark from the igniter box 200 to the igniter 118 at the top of the burner electrode 112. However, the burner electrode 112 is mounted on the burner 102 and installed from above the rangetop maintop 104, while the igniter box 200 must be located and mounted below the rangetop maintop 104. During the assembly and installation of the burner 102, burner electrode 112, igniter box 200, and the spark igniter wire 300 on the appliance, a first electrical connector 302*a* of the spark igniter wire 300 must be connected to a corresponding connector 202 on the igniter box 200 and then the spark igniter wire 300 must be routed through a first hole 134 in a burner rail (or channel) 130 that supports one or more burners, through a second hole (not visible in FIG. 4) in a heat shield 132 (if so equipped), through a third hole 136 in the maintop 104 (e.g., a spill tray) of the rangetop, and finally through a fourth hole 138 in the burner pedestal 106. In order to route the spark igniter wire 300, the maintop 104 must be propped up by the assembly personnel to provide access to each of the holes (e.g., 134, 136, 138, etc.) and to enable the assembly personnel to route the spark igniter wire 300 through the holes (e.g., 134, 136, 138, etc.) from below the maintop 104 and out of the burner 102 above the burner 102 such that the burner electrode 112 can be connected to the igniter box 200, which is located below the rangetop maintop 104. Since the spark igniter wire 300 must be routed through the holes (e.g., the first, second, third and/or fourth holes 134, 136, 138, etc.), a considerable amount of additional length of burner igniter wire 300 must be provided to permit assembly personnel to route the igniter wire 300 through each of the holes (e.g., 134, 136, 138, etc.). After the spark igniter wire 300 is routed through the components, the second electrical connector 302*b* of the spark igniter wire 300 is connected to the corresponding electrical terminal 120 of the burner electrode 112. After the igniter wire 300 is connected to the burner electrode 112, the additional length of wire needed for routing must be pushed back down through the holes (e.g., 134, 136, 138, etc.) and into the range under the rangetop maintop 104 in the space where the igniter box 200 is located such that the assembly of the burner 102 and burner electrode 112 can be mounted on the rangetop maintop 104, as shown in FIG. 5.

As a result, the assembly and installation of the burner 102, burner electrode 112, igniter box 200, and spark igniter wire 300 on the appliance according to the conventional arrangement requires a considerable amount of time and effort to complete, particularly due to the combined effect of having to prop up the maintop 104 and route the spark igniter wire 300 through one or more holes (e.g., the hole 134 in the burner rail (or channel), the hole 136 in the maintop of the rangetop, and the hole 138 in the burner base (e.g., burner pedestal). Additionally, the potential for erosion or damage to the insulation of the spark igniter wire 300 may be greatly increased by the spark igniter wire 300 having to be inserted and routed through each of these holes (e.g., 134, 136, 138), and also remaining in the holes (e.g., 134, 136, 138) where they are subject to potential erosion. The potential for erosion or damage to the insulation of the spark igniter wire 300 is further increased with each occurrence of the rangetop maintop 104 needing to be moved or lifted to perform service on the appliance, which may affect the durability and reliability of the burner igniter assembly of the appliance. Furthermore, in order to permit assembly personnel to route the igniter wire 300 through each of the holes and make the connections prior to assembling the components, the conventional spark igniter wire 300 requires a considerable amount of extra length (e.g., an extra 8 inches of length). As mentioned above, after the burner igniter wire 300 is connected to the burner electrode 112, and when the burner 102 and burner electrode 112 are mounted on the rangetop maintop 104, the additional length of wire 300 needed for the routing must be pushed down into the range under the rangetop maintop 104 in the space where the igniter box 200 is located. As a result, as shown in FIG. 5, the additional length of igniter wire 300 ordinarily will be coiled or looped around in a random and uncontrolled manner in the space below the rangetop maintop 104 when the rangetop maintop 104 is in an assembled state, which may further increase the potential for erosion or damage to the insulation of the spark igniter wire 300 and/or contact with other electronic components or wiring harnesses.

SUMMARY OF THE INVENTION

The present invention, as illustrated for example in the exemplary embodiments, provides a home cooking appliance comprising a burner rail, a maintop surface mounted over the burner rail, a burner assembly mounted above the burner rail and the maintop surface, the burner assembly including a burner electrode, an igniter box disposed below the burner rail and maintop surface, and an electrode chamber mounted on the burner rail, the electrode chamber including a body having a cavity and a first opening at a first end of the body for providing access to the cavity, wherein a portion of the burner electrode is disposed in the cavity, an electrical contact surface in the cavity that engages and electrically connects the electrical contact surface to the portion of the burner electrode, and an electrical connector at a second end of the body, the second end being opposite the first end, the electrical connector being electrically connected to the electrical contact surface and to the igniter box, thereby electrically connecting the igniter box to the portion of the burner electrode.

The present invention also provides an electrode chamber for a burner assembly of a home cooking appliance, the electrode chamber comprising a body having a cavity and a first opening at a first end of the body for providing access to the cavity, wherein the cavity is configured to receive a portion of a burner electrode of the burner assembly, an electrical contact surface in the cavity for engaging the portion of the burner electrode and electrically connecting the electrical contact surface to the portion of the burner electrode, and an electrical connector at a second end of the body, the second end being opposite the first end, the electrical connector being electrically connected to the electrical contact surface for electrically connecting the electrical contact surface to an igniter box and thereby electrically connecting the igniter box to the portion of the burner electrode received in the cavity.

In this way, the present invention provides home cooking appliance having an electrode chamber that simply and easily connects a burner electrode to an igniter box of the home cooking appliance, without routing an igniter wire through the rangetop maintop, rail, etc., in order to transfer the ignition spark from the igniter box to the top of the burner electrode. As a result, the present invention can reduce an amount of assembly time and effort required to assemble and install the burner, burner electrode, igniter box, and spark igniter wire on the home cooking appliance, thereby facilitating improved production and reducing costs.

Unlike the conventional arrangement, the present invention eliminates any need to prop up the maintop and route the spark igniter wire through one or more holes (e.g., the first hole in the burner rail (or channel), the second hole in the maintop of the rangetop, and the third hole in the burner base (e.g., burner pedestal). As a result, the present invention also reduces or eliminates the potential for erosion or damage to the insulation of the spark igniter wire, which may occur in the conventional arrangements due to the spark igniter wire having to be inserted and routed through each of these holes. The present invention further reduces or eliminates the potential for erosion or damage to the insulation of the spark igniter wire when the rangetop maintop needs to be moved or lifted to perform service on the appliance, thereby improving the durability and reliability of the burner igniter assembly of the appliance.

Furthermore, unlike the conventional arrangements that require extra length of wire in order to permit assembly personnel to route the igniter wire, the present invention eliminates the need to provide extra length of igniter wire, since it is not necessary to route the igniter wire, thereby providing greater consistency in the location of the wire in the home cooking appliance. By eliminating the need to provide extra length of wire, the present invention eliminates the presence of additional length of igniter wire being coiled or looped around in a random and uncontrolled manner in the space below the rangetop maintop when the rangetop maintop is in an assembled state, thereby further reducing the potential for erosion or damage to the insulation of the spark igniter wire and reducing the potential for contact with other electronic components or wiring harnesses.

In an exemplary embodiment, the home cooking appliance can include an electrode chamber having an electrode or electrical fitting, which is disposed below the burner rail (e.g., at or near a lower end of, or at the bottom of, the electrode chamber). In this way, an igniter wire then can be connected between the igniter box and the electrode chamber without routing the igniter wire through any other elements or openings in any other elements of the appliance, or for that matter, without routing the igniter wire outside of the area below the burner rail (e.g., between the burner rail and the rangetop floor). The electrode chamber can include a cavity having an electrical element or base within the electrode chamber (e.g., at a bottom of the cavity), which is electrically connected to the electrode or electrical fitting at the lower end or bottom of the electrode chamber.

In operation, an exemplary embodiment of the home cooking appliance, the electrode chamber can first be easily mounted on the burner rail. For example, the electrode chamber can be mounted on or in an opening in the burner rail, or on or in a notch or the like formed in the burner rail. The igniter wire then can be simply and easily connected between the igniter box and the electrode chamber without routing the igniter wire through any other elements or openings in any other elements of the appliance, or for that matter, without routing the igniter wire outside of the area below the burner rail (e.g., between the burner rail and the rangetop floor), thereby reducing assembly time and complexity of the assembly process compared to the conventional arrangements. Next, the maintop can be assembled in place. Once the maintop is in place, the burner base, which includes the gas outlet, can be mounted on the maintop or in an opening on the maintop from above and screwed in place. Next, the burner pedestal, burner body, and burner electrode can be simply and easily assembled and then mounted on the burner base from above. When the assembly of the burner pedestal, burner body, and burner electrode are mounted on the burner base, a lower end or lower portion of the burner electrode can be simply and easily received in the cavity of the electrode chamber from above such that the end of the burner electrode electrically contacts the electrical element or base within the electrode chamber, which is electrically connected to the electrode or electrical fitting of the electrode chamber that was previously connected to the igniter box by the igniter wire.

Since the end of the burner electrode is encapsulated by the electrode chamber and has electrical continuity to the electrical element (e.g., at the bottom of the electrode chamber), which has already been connected to the igniter box by the igniter wire, the assembly personnel can simply and easily drop the burner electrode into the electrode chamber from above to transfer the spark from the igniter box to the burner electrode without having to route the igniter wire through the other parts in the cooktop assembly as is required in the conventional arrangements. In this way, the present invention can reduce an amount of assembly time and effort required to assemble and install the burner assembly, including for example the burner, burner electrode, igniter box, and spark igniter wire, on the appliance, thereby facilitating improved production and reducing costs. The end of the burner electrode can be electrically connected to the electrical element or base within the electrode chamber by the physical contact between these elements and without requiring a wired connection.

In an exemplary embodiment, the end of the burner electrode can be configured to push or press against the electrical element or base within the electrode chamber when the burner is assembled. In this way, the end of the burner electrode can be electrically connected to the electrical element or base within the electrode chamber by the physical contact between these elements and without requiring a wired connection.

In another exemplary embodiment, the home cooking appliance can have an electrode chamber including a spring loaded device that biases the electrical element or base within the electrode chamber toward (e.g., upward toward) the end of the burner electrode to securely and consistently maintain electrical contact between the lower end of the burner electrode and the electrical element or base within the electrode chamber. In this way, the burner electrode can be configured to push downward against the spring force of the spring loaded device when the burner is assembled.

In an exemplary embodiment, the home cooking appliance can have an electrode chamber including a guide, such as a tapered surface for example at the top of the electrode chamber to guide the end of the burner electrode into the electrode chamber, and more particularly, toward the center of the cavity of the electrode chamber, and even more particularly, to guide the end of the burner electrode to the center of the electrical element or base within the electrode chamber.

In another exemplary embodiment, the home cooking appliance can have an electrode chamber including a locking and/or aligning feature that assists the assembly personnel in locking and/or aligning the electrode chamber with respect to the burner rail. Particularly, the electrode chamber can include a locking and/or aligning feature that assists the assembly personnel in locking and/or aligning the electrode chamber with respect to an opening of the burner rail. The locking and/or aligning feature can engage a portion of the burner rail and/or a portion of the burner base to lock and/or align the electrode chamber in a fixed position (e.g., a predetermined fixed position). For example, in an exemplary embodiment, the electrode chamber can include a flange or lip having a dimension (e.g., diameter) that is larger than a dimension (e.g., diameter) of a body portion of the electrode chamber. The flange or lip can be disposed above the burner rail when the electrode chamber is mounted on the burner rail such that the body of the electrode chamber extends downward through the opening in the burner rail. The flange or lip can prevent the electrode chamber from passing entirely through the opening in the burner rail. In an exemplary embodiment, the flange or lip can include a notch, cutout, projection, etc. that engages one or more corresponding elements or surfaces of the burner rail, the burner base, or another component of the burner assembly to lock and/or align the electrode chamber in a fixed position (e.g., predetermined fixed position).

The exemplary home cooking appliance can have an electrode chamber including a housing formed from a material that is, for example, resistant to or capable of withstanding the high temperatures that are present at the burner during use of the burner. The housing of the exemplary electrode chamber can be formed from a material such as an electrically non-conductive material, including for example plastic, porcelain, ceramic, etc. The electrically non-conductive material, including for example plastic, porcelain, ceramic, etc., can be selected to be a material with a high temperature rating. Alternatively, the electrode chamber can include a sleeve, coating, or the like formed from an electrically non-conductive material to encapsulate and insulate the end of the burner electrode therein when assembled. In this alternative embodiment, the body of the electrode chamber can be formed from any material, including an electrically conductive material, which may improve strength and durability of the electrode chamber.

In an exemplary embodiment, the home cooking appliance can have an electrode chamber including an electrical contact surface at the lower end or lower region of the body of the burner electrode for contacting the electrical element or base within the electrode chamber. The electrical contact surface at the lower end or lower region of the body of the burner electrode can have a size and shape that corresponds to a size and shape of the electrical element or base within the electrode chamber. In other embodiments, a size and shape of the electrical contact surface at the lower end or lower region of the body of the burner electrode can be different from a size and shape of the electrical element or base within the electrode chamber. For example, the electrical contact surface of the burner electrode can be smaller than the electrical element or base within the electrode chamber such that the electrical contact surface of the burner electrode still contacts the electrical element or base within the electrode chamber even in instances in which the burner electrode is not correctly aligned or centered within the electrode chamber.

In yet another embodiment, the electrical contact surface of the burner electrode can include a blunt surface, flat surface, rounded surface, or the like that contacts the electrical element or base within the electrode chamber, for example, to increase an amount of contact between the electrical contact surface of the burner electrode and the electrical element or base within the electrode chamber thereby ensuring or improving the electrical connection between these elements.

In another embodiment, the electrical contact surface of the burner electrode can include a portion that engages a recess or socket element formed by or in the electrical element or base of the electrode chamber. Alternatively, the electrical element or base of the electrode chamber can include a portion that engages a recess or socket element formed by or in the electrical contact surface of the burner electrode.

One of ordinary skill in the art will recognize that an exemplary embodiment of the home cooking appliance can include an electrode chamber that is configured to receive a conventional burner electrode, which includes an electrical fitting or wire connector at a lower end, such that the electrical fitting or wire connector of the burner electrode electrically contacts the electrical element or base of the electrode chamber by the physical contact between these elements and without a wired connection.

In another exemplary embodiment, the home cooking appliance can include an electrode chamber that can be directly electrically connected to the igniter box without an igniter wire. For example, the electrode chamber can include an electrical fitting or connection that directly engages a corresponding electrical fitting or connection on the igniter box. More particularly, for example, the electrode chamber can include an electrical fitting or connection that snaps (e.g., snap fits or friction fits) directly into or onto a corresponding electrical fitting or connection on the igniter box. In this way, the electrical connection between the electrode chamber and the igniter box can be easily and simply provided by connecting the electrode chamber to the igniter box. Moreover, this exemplary embodiment can eliminate the igniter wire altogether, thereby further simplifying and reducing the amount of time and effort associated with the assembly process.

In operation, an exemplary embodiment of the home cooking appliance can include an electrode chamber that can first be easily mounted on the burner rail. For example, the electrode chamber can be mounted to or mounted in an opening in the burner rail. The electrode chamber then simply and easily can be connected directly to the igniter box, for example, by a snap-fit or friction-fit connection, thereby electrically connecting the electrode chamber and the igniter box. Alternatively, the electrode chamber first can be connected directly to the igniter box, for example, by a snap-fit or friction-fit connection, thereby electrically connecting the electrode chamber and the igniter box, and then the assembly of the electrode chamber and the igniter box can be mounted on or in an opening of the burner rail. In this way, the electrode chamber can be directly electrically connected to the igniter box without an igniter wire at all, thereby reducing assembly time and complexity of the assembly process compared to the conventional arrangements. The assembly process can continue similar to the process explained above, with the maintop next being assembled in place, followed by the burner base being mounted on the maintop or in an opening on the maintop from above and screwed in place, and the burner pedestal, burner body, and burner electrode being assembled and then mounted on the burner base from above. As with the exemplary embodiment described above, when the assembly of the burner pedestal, burner body, and burner electrode are mounted on the burner base, a lower end or portion of the burner electrode can be simply and easily received in the cavity of the electrode chamber from above such that the end of the burner electrode electrically contacts the electrical element or base within the electrode chamber, which is electrically connected to the electrode or electrical fitting of the electrode chamber that was previously connected directly to the igniter box without any igniter wire. Since the end of the burner electrode is encapsulated by the electrode chamber and has electrical continuity to the electrical element (e.g., at the bottom of the electrode chamber), which has already been directly connected to the igniter box without an igniter wire, the assembly personnel can simply and easily drop the burner electrode into the electrode chamber from above to transfer the spark from the igniter box to the burner electrode without having to route an igniter wire through the other parts in the cooktop assembly as is required in the conventional arrangements. In this way, the present invention can reduce an amount of assembly time and effort required to assemble and install the burner assembly, including for example the burner, burner electrode, and igniter box on the appliance, thereby facilitating improved production and reducing costs.

In the embodiments described above, the home cooking appliance has an electrode chamber that is mounted on or in an opening of the burner rail. However, other arrangements are possible within the spirit and scope of the invention so long as the burner electrode can be dropped into the electrode chamber to provide the electrical connection between these elements. For example, in an exemplary embodiment, the electrode chamber can be disposed under an opening in the burner rail such that an end of the burner electrode passes through the opening and is received by the electrode chamber in the manner described above. In another exemplary embodiment, the burner rail also may include a separate sleeve, coating, or the like that is formed in or on the opening in the burner rail and that is formed by an electrically non-conductive material.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
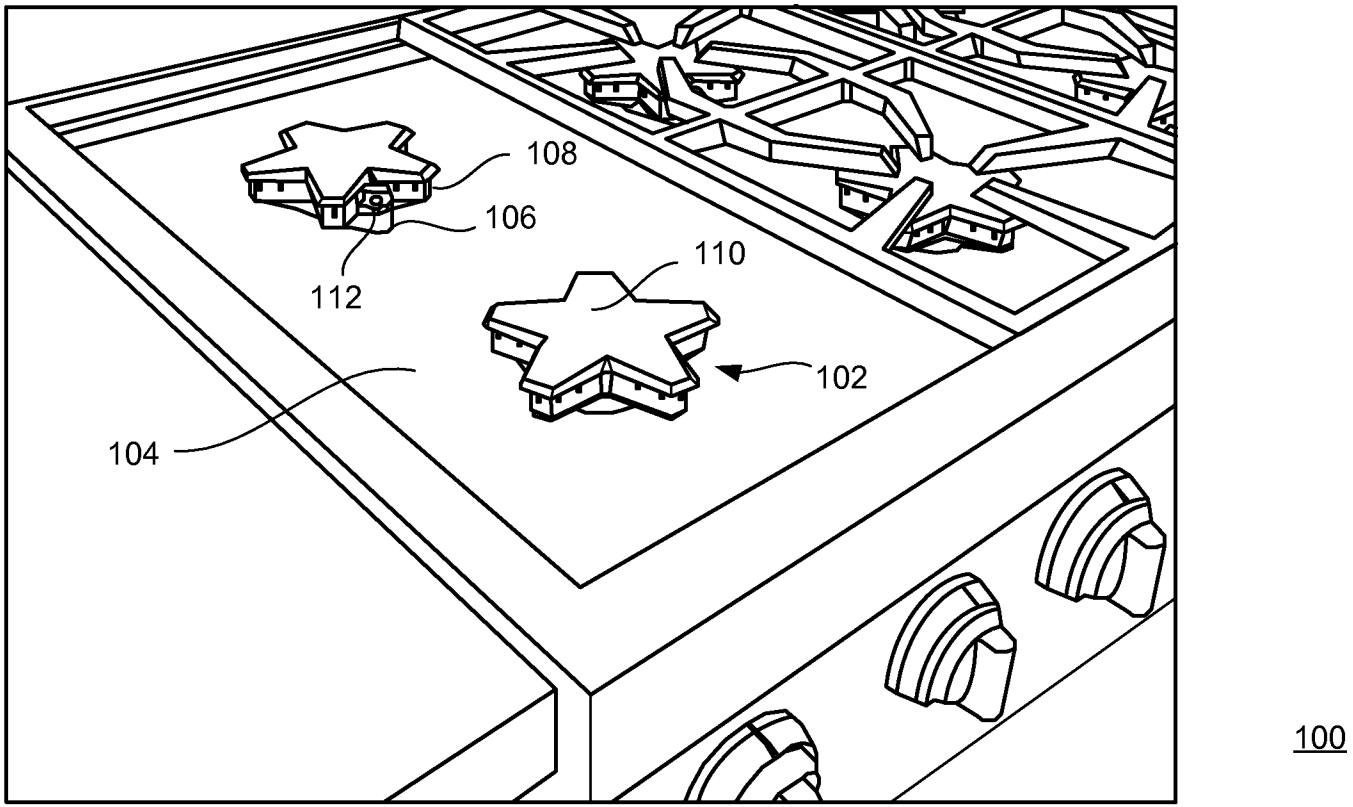
FIG. 1 CONVENTIONAL ART
FIG. 1 is a partial perspective view of a conventional home cooking appliance.
Figure 3:
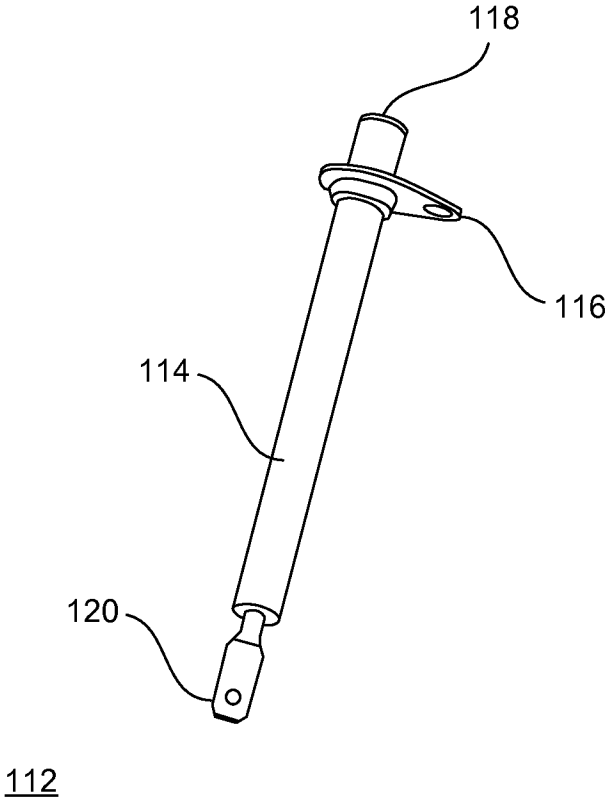
FIG. 3 CONVENTIONAL ART
FIG. 3 is a perspective view of a burner electrode of a conventional home cooking appliance.
Figure 2:
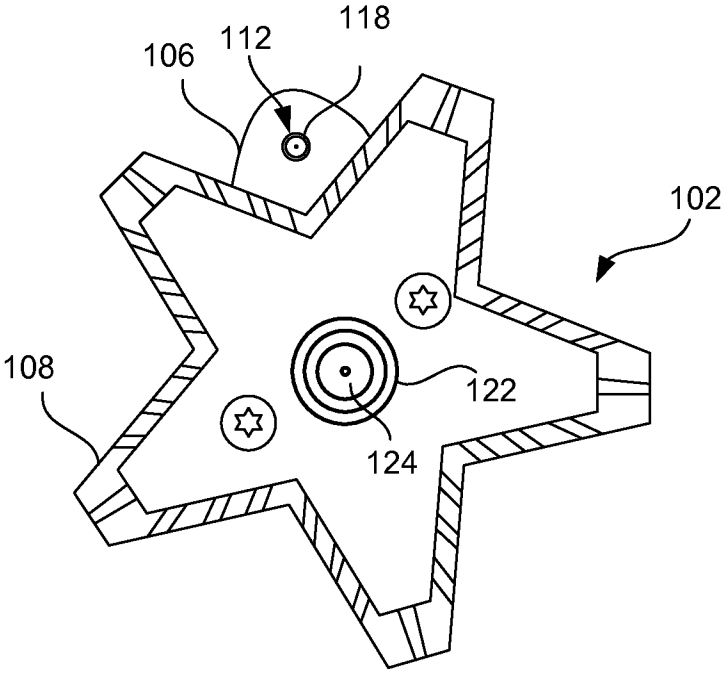
FIG. 2 CONVENTIONAL ART
FIG. 2 is a plan view of a burner of a conventional home cooking appliance.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 6-16 illustrate exemplary embodiments of a home cooking appliance having an electrode chamber 400, and a home cooking appliance having a burner assembly with an electrode chamber 400, according to exemplary embodiments of the invention.

With reference to FIGS. 6-8D, a home cooking appliance, such as a range or cooktop, can include a gas burner 102 mounted on a rangetop maintop 104 of the appliance. The burner 102 can include, for example, a burner pedestal 106, a burner body 108, a burner head 110, and a burner electrode 500 having an igniter 504 for igniting the gas supplied to the burner 102. The burner electrode 112 is mounted in the burner 102 above the rangetop maintop 104 (e.g., a spill tray) and must be electrically connected to an igniter box 200, which is located below the rangetop maintop 104) (e.g., on a rangetop floor 131 of the appliance). The burner 102 can include a venture tube 122 extending from a gas outlet 124 to the top of the burner 102. A burner electrode 500 can include a body 502 having a mounting bracket (506, shown in FIGS. 14 and 15), an igniter 504, and an electrical connector (508, shown in FIGS. 14 and 15) for connecting the burner electrode 500 to the igniter box 200.

With reference again to FIGS. 6 and 7, and also FIGS. 8A-8D, an exemplary embodiment provides a home cooking appliance including, for example, a burner rail 130, a maintop surface 104 mounted over the burner rail 130, a burner assembly mounted above the burner rail 130 and the maintop surface 104, the burner assembly including a burner electrode 500, an igniter box 200 disposed below the burner rail 130 and maintop surface 104, and an electrode chamber 400 mounted on the burner rail 130, the electrode chamber 400 including a body 402 having a cavity 404 and a first opening 405 at a first end of the body 402 for providing access to the cavity 404, wherein a portion of the burner electrode 500 is disposed in the cavity 404, an electrical contact surface 406 in the cavity 404 that engages and electrically connects the electrical contact surface 406 to the portion of the burner electrode 500, and an electrical connector 408 at a second end of the body 402, the second end being opposite the first end, the electrical connector 408 being electrically connected to the electrical contact surface 406 and to the igniter box 200, thereby electrically connecting the igniter box 200 to the portion of the burner electrode 500.

The present invention also provides an electrode chamber 400, for a burner assembly of a home cooking appliance, that simply and easily connects the burner electrode 500 to an igniter box 200 of the home cooking appliance, without routing the igniter wire 300 through the rangetop maintop, rail, etc. As a result, the present invention can reduce an amount of assembly time and effort required to assemble and install the burner 102, burner electrode 500, igniter box 200, and spark igniter wire 300 on the appliance, thereby facilitating improved production and reducing costs. For example, the electrode chamber 400 can include a body 402 having a cavity 404 and a first opening at a first end of the body 402 for providing access to the cavity 404, wherein the cavity 404 is configured to receive a portion of a burner electrode 500 of the burner assembly, an electrical contact surface 406 in the cavity 404 for engaging the portion of the burner electrode 500 and electrically connecting the electrical contact surface 406 to the portion of the burner electrode 500, and an electrical connector 408 at a second end of the body 402, the second end being opposite the first end, the electrical connector 408 being electrically connected to the electrical contact surface 406 for electrically connecting the electrical contact surface 406 to an igniter box 200 and thereby electrically connecting the igniter box 200 to the portion of the burner electrode 500 received in the cavity 404.

In this way, the present invention provides a home cooking appliance having an electrode chamber 400 that simply and easily connects a burner electrode 500 to an igniter box 200 of a home cooking appliance, without routing an igniter wire 300 through the rangetop maintop, rail 130, etc., in order to transfer the ignition spark from the igniter box 200 to the top of the burner electrode 500. As a result, the present invention can reduce an amount of assembly time and effort required to assemble and install the burner, burner electrode, igniter box 200, and spark igniter wire 300 on the appliance, thereby facilitating improved production and reducing costs. The present invention eliminates the need to provide extra length of igniter wire 300, since it is not necessary to route the igniter wire 300, thereby providing greater consistency in the location of the wire 300 in the appliance. By eliminating the need to provide extra length of wire as shown in the examples illustrated in FIGS. 6 and 7, the present invention eliminates the presence of additional length of igniter wire 300 being coiled or looped around in a random and uncontrolled manner in the space below the rangetop maintop when the rangetop maintop is in an assembled state, thereby further reducing the potential for erosion or damage to the insulation of the spark igniter wire 300 and reducing the potential for contact with other electronic components or wiring harnesses.

With reference again to FIGS. 6 and 7, in an exemplary embodiment, the home cooking appliance has an electrode chamber 400 including an electrode or electrical fitting, which is disposed below the burner rail 130 (e.g., at or near a lower end of, or at the bottom of, the electrode chamber 400). In this way, an igniter wire 300 then can be connected between the igniter box 200 and the electrode chamber 400 without routing the igniter wire 300 through any other elements or openings in any other elements of the appliance, or for that matter, without routing the igniter wire 300 outside of the area below the burner rail 130 (e.g., between the burner rail 130 and the rangetop floor). The electrode chamber 400 can include a body 402 having a cavity 404 with an electrical element or base 406 within the electrode chamber 400 (e.g., at a bottom of the cavity 404), which is electrically connected to the electrode or electrical fitting 408 at the lower end or bottom of the electrode chamber 400. In operation, the igniter box 200 can first be mounted on a floor 131 of the cooktop. An exemplary embodiment of the electrode chamber 400 can then be mounted on the burner rail 130. For example, the electrode chamber 400 can be mounted on or in an opening in the burner rail 130, or on or in a notch or the like formed in the burner rail 130. The igniter wire 300 then can be simply and easily connected between the igniter box 200 and the electrode chamber 400 by connecting the wire connectors 302*a* and 302*b* to corresponding wire connectors on the igniter box 200 and the electrode chamber 400, respectively, without routing the igniter wire 300 through any other elements or openings in any other elements of the appliance, or for that matter, without routing the igniter wire 300 outside of the area below the burner rail 130 (e.g., between the burner rail 130 and the rangetop floor). Next, the maintop 104 can be assembled in place. Once the maintop 104 is in place, the burner base 126, which includes the gas outlet 124, can be mounted on the maintop 104 or in an opening on the maintop 104 from above and screwed in place. Next, the burner pedestal 106, burner body 108, and burner electrode 500 can be assembled and then mounted on the burner base 126 from above.

Figure 7:
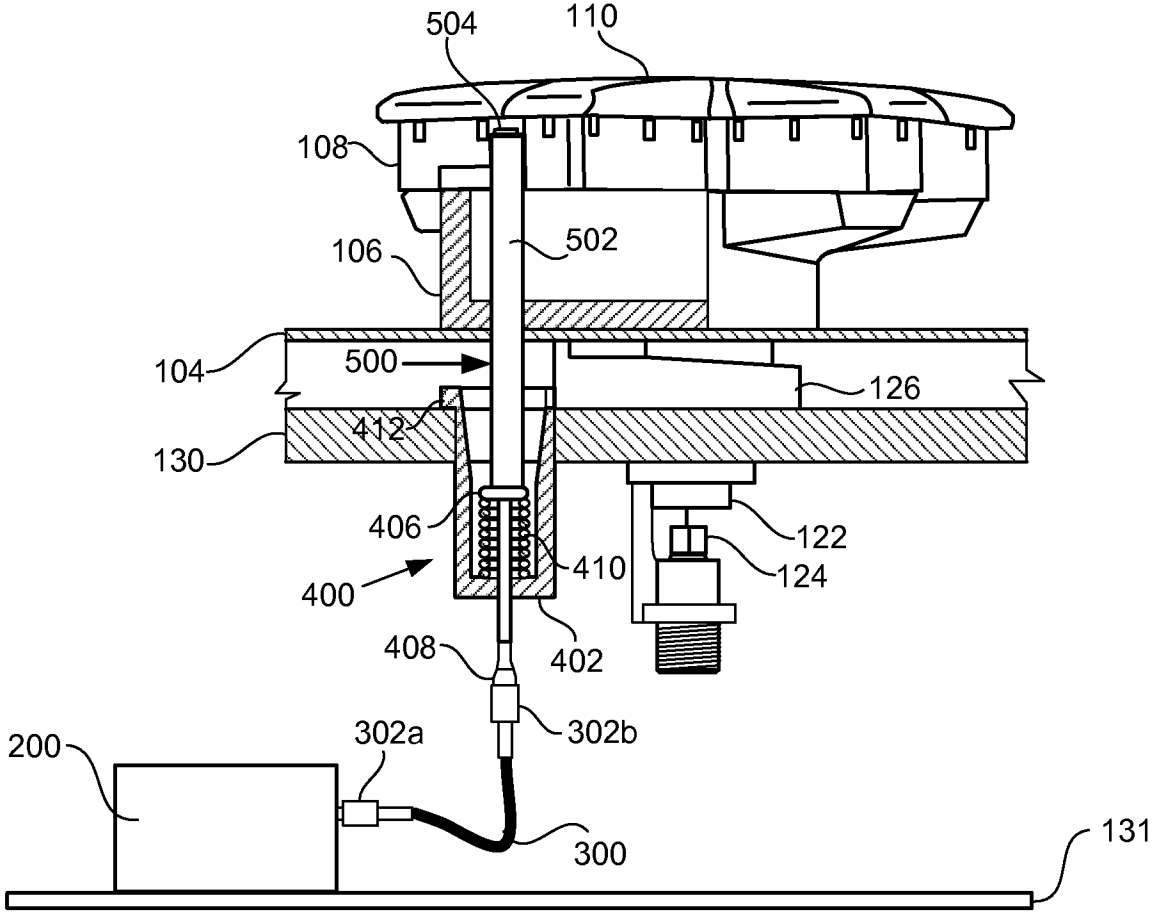
FIG. 7 is a partial, cross-sectional view of a burner assembly of a home cooking appliance having an electrode chamber according to an exemplary embodiment of the invention.
Figure 8D:
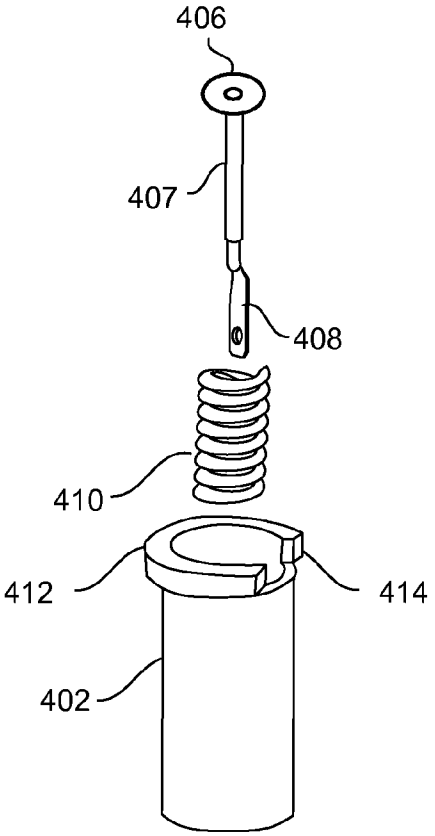
FIG. 8D is an exploded view of an electrode chamber according to an exemplary embodiment of the invention.
Figure 8B:
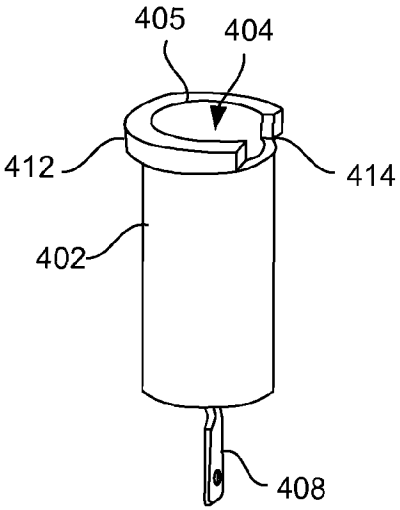
FIG. 8B is another perspective view.
Figure 8A:
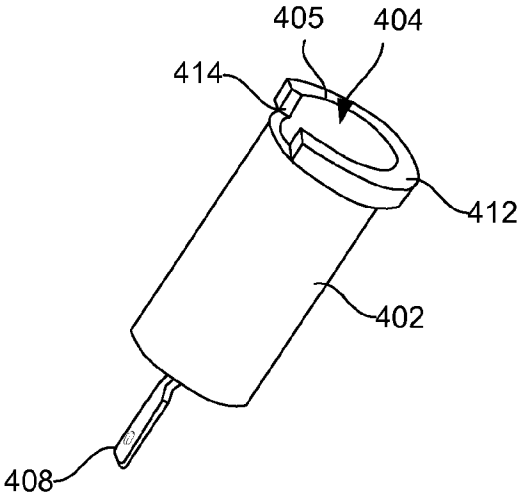
FIG. 8A is a perspective view.
Figure 8C:
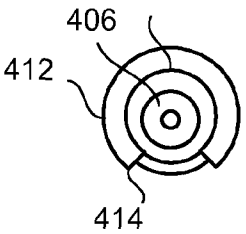
FIG. 8C is a top view.

As shown in FIG. 7, when the assembly of the burner pedestal 106, burner body 108, and burner electrode 500 are mounted on the burner base 126, a lower end or portion of the burner electrode 500 can be simply and easily received in the cavity 404 of the electrode chamber 400 through the opening 405 from above such that the end of the burner electrode 500 electrically contacts the electrical element or base within the electrode chamber 400, which is electrically connected to the electrode or electrical fitting of the electrode chamber 400 that was previously connected to the igniter box 200 by the igniter wire 300. Since the end of the burner electrode 500 is encapsulated by the electrode chamber 400 and has electrical continuity to the electrical element 406 (e.g., at the bottom of the electrode chamber 400), which has already been connected to the igniter box 200 by the igniter wire 300, the assembly personnel can simply and easily drop the burner electrode 500 into the electrode chamber 400 from above to transfer the spark from the igniter box 200 to the burner electrode 500 without having to route the igniter wire 300 through the other parts in the cooktop assembly as is required in the conventional arrangements. The end of the burner electrode 500 can be electrically connected to the electrical element or base within the electrode chamber 400 by the physical contact between these elements and without requiring a wired connection.

In an exemplary embodiment, the end of the burner electrode 500 can be configured to be push or press against the electrical element or base 406 within the electrode chamber 400 when the burner is assembled. In this way, the end of the burner electrode 500 can be electrically connected to the electrical element or base 406 within the electrode chamber 400 by the physical contact between these elements and without requiring a wired connection.

In another exemplary embodiment, the electrode chamber 400 can include a spring loaded device (e.g., 410) that biased the electrical element or base 406 within the electrode chamber 400 toward (e.g., upward toward) the end of the burner electrode 500 to securely and consistently maintain electrical contact between the lower end of the burner electrode 500 and the electrical element or base 406 within the electrode chamber 400. In this way, the burner electrode 500 can be configured to push downward against the spring force of the spring loaded device when the burner is assembled. As shown in FIG. 7, the spring loaded device can include a spring 410 disposed in the chamber 404 between the electrical element 406 and the bottom of the chamber 404. One of ordinary skill in the art will recognize that other biasing elements can be used to bias the electrical element 406 upward toward the burner electrode 500. For example, a resilient member can be provided, such as a resilient rubber member or the like. The spring or resilient member can be disposed in the chamber 404, as shown in the exemplary embodiments, or outside the chamber 404. For example, a spring or resilient member conceivably can be arranged under or above the electrode chamber 400, so long as the electrical element 406 is biased toward the end of the burner electrode 500 to maintain electrical contact.

The exemplary home cooking appliance can include an electrode chamber 400 having a housing body 402 formed from a material that is, for example, resistant to or capable of withstanding the high temperatures that are present at the burner during use of the burner. The housing of the exemplary electrode chamber 400 can be formed from a material such as an electrically non-conductive material, including for example plastic, ceramic, etc. The electrically non-conductive material, including for example plastic, porcelain, ceramic, etc., can be selected to be a material with a high temperature rating. Alternatively, the electrode chamber 400 can include a sleeve, coating, or the like formed from an electrically non-conductive material to encapsulate and insulate the end of the burner electrode 500 therein when assembled. In this alternative embodiment, the body 402 of the electrode chamber 400 can be formed from any material, including an electrically conductive material, which may improve strength and durability of the electrode chamber 400.

An exemplary embodiment of a home cooking appliance having an electrode chamber 400 is illustrated in FIGS. 8A-8D. FIGS. 9A-9C and 10A-10B illustrate the components of the electrode chamber 400 of the exemplary embodiment in greater detail. For example, with reference to FIGS. 9A-9C, the electrode chamber 400 can include a housing or body 402 having a cavity 404 formed therein and accessible via an opening 405 in the upper end of the body 402. The body 402 is illustrated as being cylindrical. However, other shapes can be used depending on the size and shape of the opening or notch in which the electrode chamber 400 is mounted. Similarly, the cavity 404 is illustrated as being substantially or at least partially cylindrical. However, the cavity 404 can have another suitable size and shape, such as a conical section or part conical section, an inverted pyramidal section or partial pyramidal section, etc. The exemplary electrode chamber 400 is illustrated as having a circular flange or lip 412. However, in other embodiments, the electrode chamber 400 can include a flange or lip having another shape, such as a rectangular shape or square shape, or one or more separate projections extending from a perimeter of an upper end of the body 402, which projections may be separated by space in between.

Figure 9C:
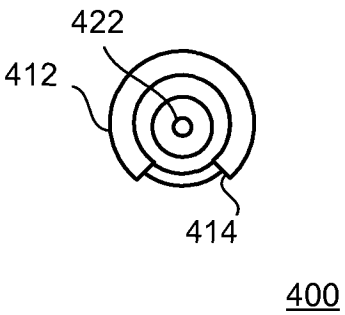
FIG. 9C is a top view of a body of an electrode chamber according to an exemplary embodiment of the invention.
Figure 9B:
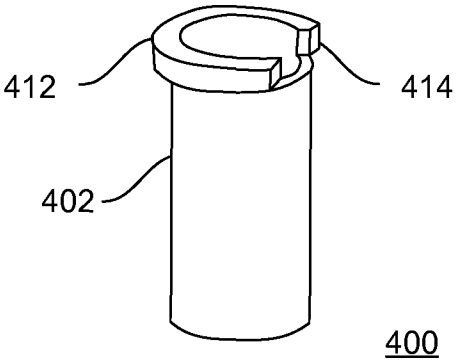
FIG. 9B is a perspective view.
Figure 9A:
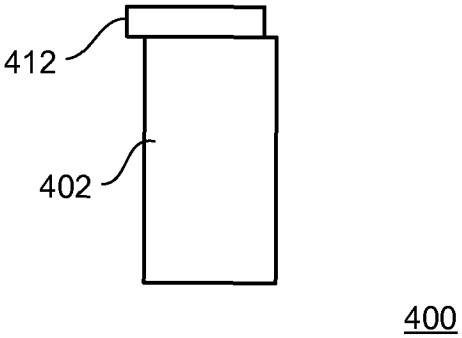
FIG. 9A is a side view.
Figure 10B:
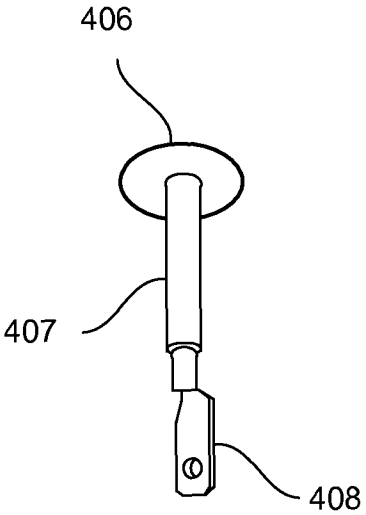
FIG. 10A is a side view and FIG. 10B is a perspective view of an electrical contact surface and electrical connector of an electrode chamber according to an exemplary embodiment of the invention.
Figure 10A:
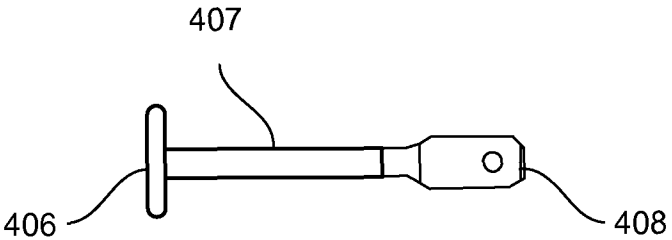

With reference to FIGS. 9C, 10A, and 10B, the electrode chamber 400 can include an electrical element or base 406 to be disposed within the electrode chamber 400 and an electrical connector 408 extending out of the electrode chamber 400. A connecting rod 407 or the like can be provided to electrically connect the electrical element or base 406 to the electrical connector 408. The connecting rod 407 can be configured to pass through the electrode chamber 400 via an opening 422, as shown for example in FIG. 9C (and, e.g., FIG. 11) to permit the electrical connector 408 to be disposed on the outside of the electrode chamber 400. The electrical element or base 406, the electrical connector 408, and the connecting rod 407 are not limited to the illustrated embodiments and can have other sizes, shapes, and arrangements.

Figure 11:
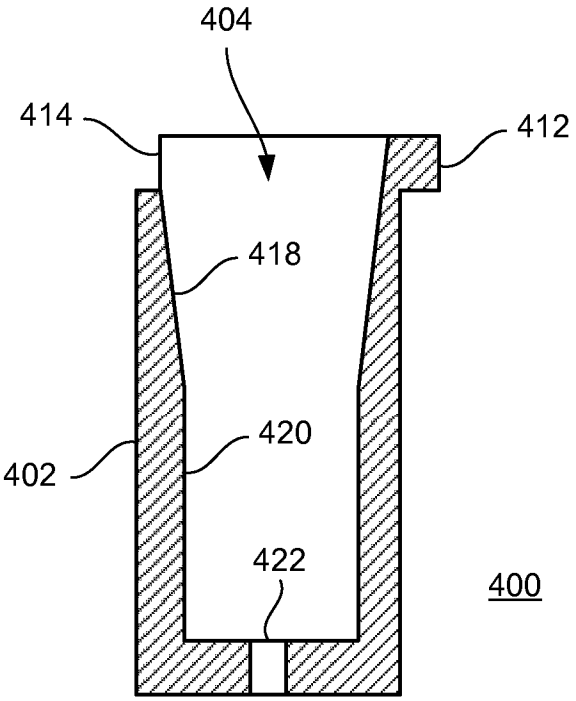
FIG. 11 is a side, cross-sectional view of a body of an electrode chamber according to an exemplary embodiment of the invention.

With reference to FIG. 11, in an exemplary embodiment, the home cooking appliance can include an electrode chamber 400 having a guide, such as a tapered interior surface 418 for example at the top of the cavity 404 of the electrode chamber 400 to guide the end of the burner electrode 500 into the electrode chamber 400, and more particularly, toward the center of the cavity 404 of the electrode chamber 400, and more particularly, to guide the end of the burner electrode 500 to the center of the electrical element or base 406 within the electrode chamber 400. The entire interior surface of the cavity 404 can be tapered or only a portion of the cavity can be tapered. For example, the cavity 404 can include a tapered portion 418 and a non-tapered portion 420.

Figure 4:
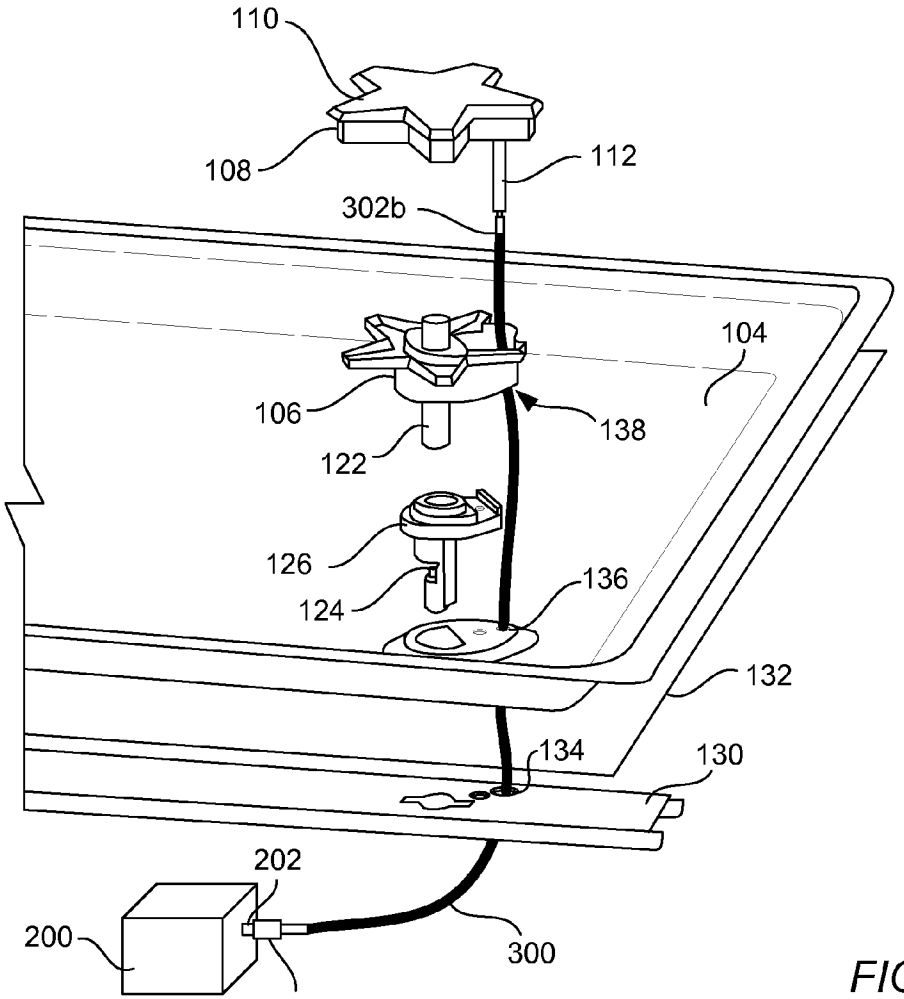
FIG. 4 CONVENTIONAL ART
FIG. 4 is a partial, exploded, perspective view of a cooktop assembly of a conventional home cooking appliance.
Figure 5:
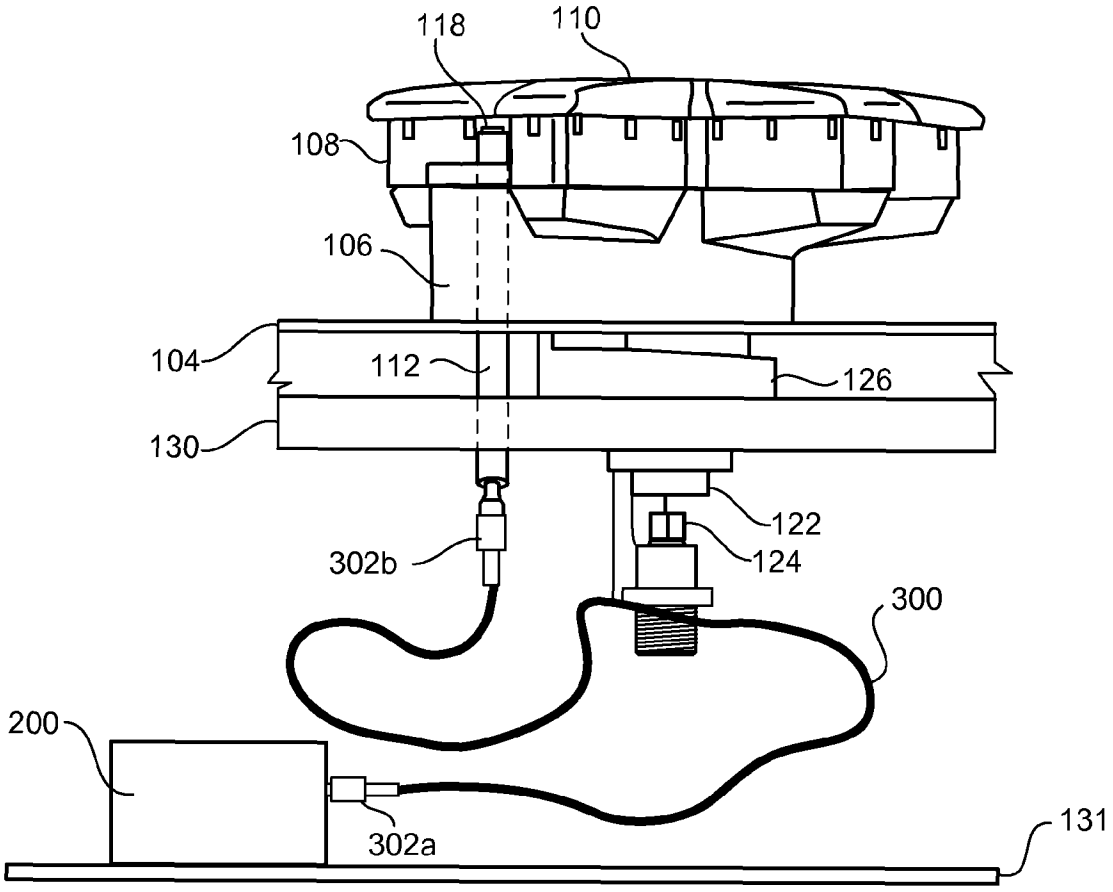
FIG. 5 CONVENTIONAL ART
FIG. 5 is a partial view of a cooktop assembly of a conventional home cooking appliance.
Figure 6:
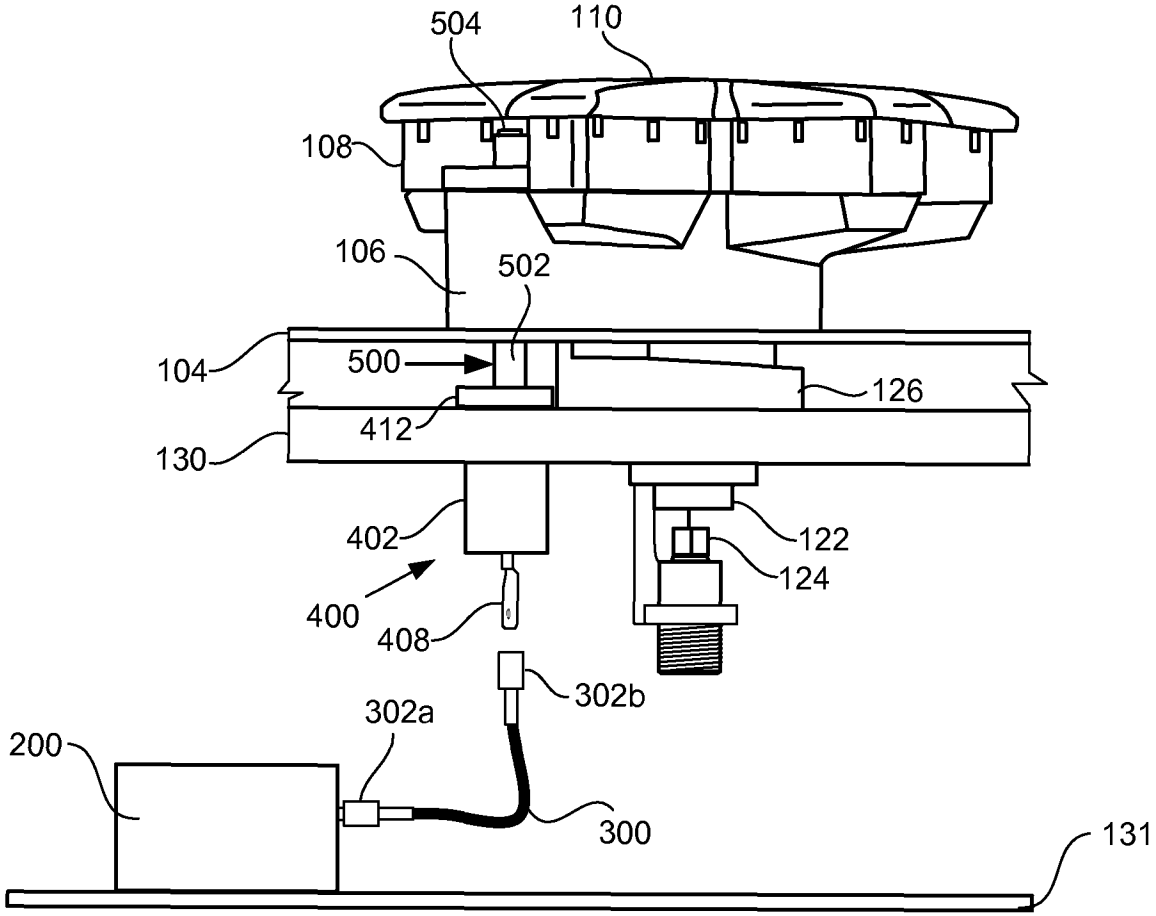
FIG. 6 is a partial view of a burner assembly of a home cooking appliance having an electrode chamber according to an exemplary embodiment of the invention.
Figure 12:
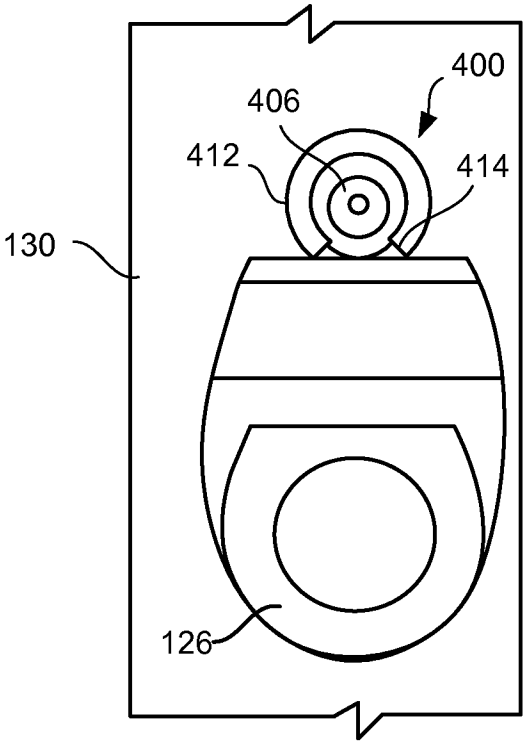
FIG. 12 is a top view of a partial assembly of a burner base and burner rail having a body of an electrode chamber according to an exemplary embodiment of the invention.

With reference to FIG. 12, in another exemplary embodiment, the home cooking appliance can include an electrode chamber 400 having a locking and/or aligning feature (e.g., 414) that assists the assembly personnel in locking and/or aligning the electrode chamber 400 with respect to the burner rail 130. Particularly, the electrode chamber 400 can include a locking and/or aligning feature 414 that assists the assembly personnel in locking and/or aligning the electrode chamber 400 with respect to an opening (e.g., 134 in FIG. 4) of the burner rail 130. The locking and/or aligning feature 414 can lock and/or align engage a portion of the burner rail 130, the opening (e.g., 134 in FIG. 4) of the burner rail 130, and/or a portion of the burner base 126 to lock and/or align the electrode chamber 400 in a fixed position (e.g., predetermined fixed position). For example, in an exemplary embodiment shown in FIGS. 6-12, the electrode chamber 400 can include a flange or lip 412 having a dimension (e.g., diameter) that is larger than a dimension (e.g., diameter) of a body 402 of the electrode chamber 400. The flange or lip 412 can be disposed above the burner rail 130 when the electrode chamber 400 is mounted on the burner rail 130 such that the body 402 of the electrode chamber 400 extends downward through the opening in the burner rail 130. The flange or lip 412 can prevent the electrode chamber 400 from passing entirely through the opening (e.g., 134 in FIG. 4) in the burner rail 130. In the exemplary embodiment illustrated in FIG. 12, the flange or lip 412 can include a cutout 414 that enables the flange or lip 412 to engage a surface of the burner base 126 to lock and/or align the electrode chamber 400 in a fixed position (e.g., predetermined fixed position). As shown in the exemplary embodiment illustrated in FIG. 12, when the electrode chamber 400 is mounted in an opening (e.g., 134 in FIG. 4) in the burner rail 130, the cutout 414 engages a part of the burner base 126 and prevents the electrode chamber 400 from moving (e.g., rotating) with respect to the opening in the burner base 126. In other alternative embodiments, the electrode chamber 400 can include other locking features such as a notch, cutout, projection, etc. on the flange or lip 412 or other parts of the electrode chamber 400 that engage one or more corresponding elements or surfaces of another component, such as the burner rail 130, the burner base 126, etc. of the burner assembly to lock and/or align the electrode chamber 400 in a fixed position (e.g., predetermined fixed position).

Figure 14:
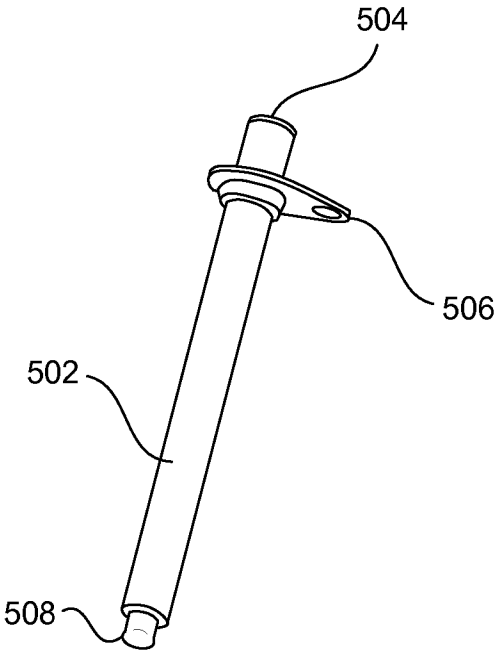
FIG. 14 is a perspective view of a burner electrode according to an exemplary embodiment of the invention.
Figure 13:
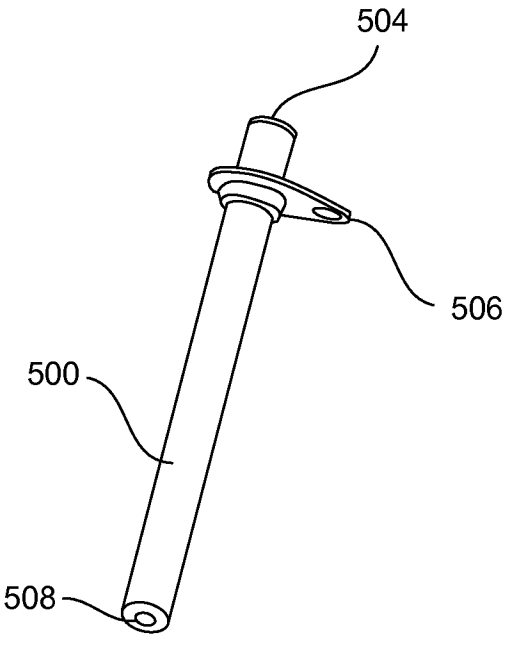
FIG. 13 is a perspective view of a burner electrode according to an exemplary embodiment of the invention.

With reference to FIGS. 13 and 14, the home cooking appliance can include a burner electrode 500 having an electrical contact surface 508 at the lower end or lower region of the body 502 of the burner electrode 500 for contacting the electrical element or base 406 within the electrode chamber 400. The electrical contact surface 508 at the lower end or lower region of the body 502 of the burner electrode 500 can have a size and shape that corresponds to a size and shape of the electrical element or base 406 within the electrode chamber 400. In other embodiments, a size and shape of the electrical contact surface 508 at the lower end or lower region of the body 502 of the burner electrode 500 can be different from a size and shape of the electrical element or base 406 within the electrode chamber 400. For example, the electrical contact surface 508 of the burner electrode 500 can be smaller than the electrical element or base 406 within the electrode chamber 400 such that the electrical contact surface 508 of the burner electrode 500 still contacts the electrical element or base 406 within the electrode chamber 400 even in instances in which the burner electrode 500 is not correctly aligned or centered within the electrode chamber 400. In another embodiment, the electrical contact surface 508 of the burner electrode 500 can include a blunt surface, flat surface, rounded surface, or the like that contacts the electrical element or base 406 within the electrode chamber 400, for example, to increase an amount of contact between the electrical contact surface 406 of the burner electrode 500 and the electrical element or base 406 within the electrode chamber 400 thereby ensuring or improving the electrical connection between these elements 406, 508.

In an alternative embodiment, the electrical contact surface 508 of the burner electrode 500 can include a portion that engages a recess or socket element (not shown) formed by or in the electrical element or base 406 of the electrode chamber 400. Alternatively, the electrical element or base 406 of the electrode chamber 400 can include a portion that engages a recess or socket element (not shown) formed by or in the electrical contact surface 508 of the burner electrode 500.

One of ordinary skill in the art will recognize that an exemplary embodiment of the home cooking appliance can include a electrode chamber 400 that can be configured to receive a conventional burner electrode 500, which includes an electrical fitting or wire connector at a lower end, such that the electrical fitting or wire connector of the burner electrode 500 electrically contacts the electrical element or base of the electrode chamber 400 by the physical contact between these elements and without a wired connection.

Figure 15:
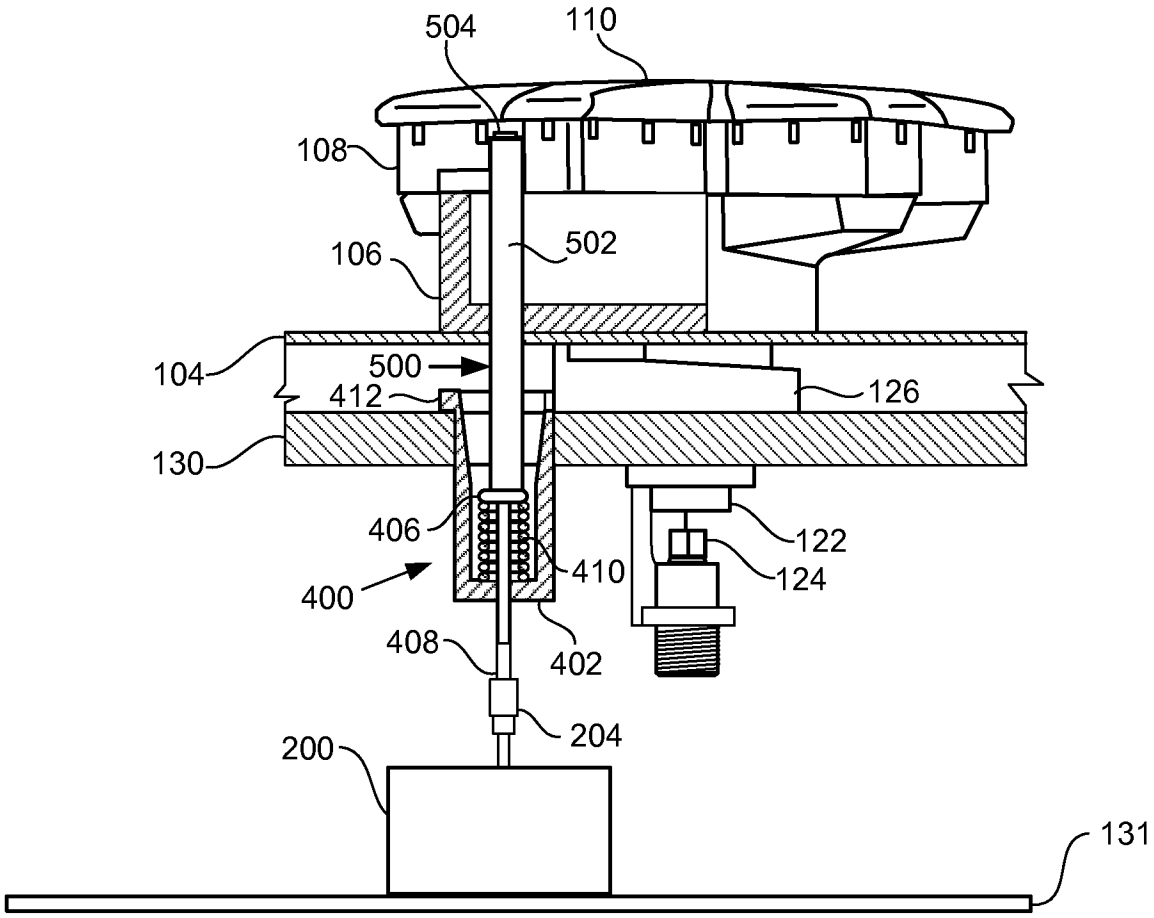
FIG. 15 is a partial, cross-sectional view of a burner assembly of a home cooking appliance having an electrode chamber according to another exemplary embodiment of the invention.

With reference to FIG. 15, in another exemplary embodiment, the home cooking appliance can include an electrode chamber 400 that can be directly electrically connected to the igniter box 200 without an igniter wire 300 at all. For example, as illustrated in the exemplary embodiment shown in FIG. 15, the electrode chamber 400 can include an electrical fitting or connector 408 that directly engages a corresponding electrical fitting or connector 204 on the igniter box 200. For example, the electrode chamber 400 can include an electrical fitting or connector 408 that snaps (e.g., snap fits or friction fits) directly into or onto a corresponding electrical fitting or connector 204 on the igniter box 200. In this way, the electrical connection between the electrode chamber 400 and the igniter box 200 can be easily and simply provided by connecting the electrode chamber 400 to the igniter box 200. Moreover, this exemplary embodiment can eliminate the igniter wire 300 altogether, thereby further simplifying and reducing the amount of time and effort associated with the assembly process. In operation, an exemplary embodiment of the electrode chamber 400 can first be easily mounted on the burner rail 130. For example, the electrode chamber 400 can be mounted to or mounted in an opening in the burner rail 130. The electrode chamber 400 then can be connected directly to the igniter box 200, for example, by a snap-fit or friction-fit connection, thereby electrically connecting the electrode chamber 400 and the igniter box 200. Alternatively, the electrode chamber 400 first can be connected directly to the igniter box 200, for example, by a snap-fit or friction-fit connection, thereby electrically connecting the electrode chamber 400 and the igniter box 200, and then the assembly of the electrode chamber 400 and the igniter box 200 can be mounted on or in an opening of the burner rail 130. In this way, the electrode chamber 400 can be directly electrically connected to the igniter box 200 without an igniter wire 300 at all, thereby reducing assembly time and complexity of the assembly process compared to the conventional arrangements. The assembly process can continue similar to the process explained above, with the maintop 104 next being assembled in place, followed by the burner base 126 being mounted on the maintop 104 or in an opening on the maintop from above and screwed in place, and the burner pedestal 106, burner body 108, and burner electrode 500 being assembled and then mounted on the burner base 126 from above. As with the exemplary embodiment described above, when the assembly of the burner pedestal 106, burner body 108, and burner electrode 500 are mounted on the burner base 126, a lower end or portion of the burner electrode 500 can be simply and easily received in the cavity 404 of the electrode chamber 400 from above such that the end of the burner electrode 500 electrically contacts the electrical element or base 406 within the electrode chamber 400, which is electrically connected to the electrode or electrical connector 408 of the electrode chamber 400 that was previously connected directly to the igniter box 200 without any igniter wire 300. Since the end of the burner electrode 500 is encapsulated by the electrode chamber 400 and has electrical continuity to the electrical element (e.g., at the bottom of the electrode chamber 400), which has already been directly connected to the igniter box 200 without an igniter wire 300, the assembly personnel can simply and easily drop the burner electrode 500 into the electrode chamber 400 from above to transfer the spark from the igniter box 200 to the burner electrode 500 without having to route an igniter wire 300 through the other parts in the cooktop assembly. In this way, the present invention can reduce an amount of assembly time and effort required to assemble and install the burner assembly, including for example the burner 102, burner electrode 500, and igniter box 200 on the appliance, thereby facilitating improved production and reducing costs.

The igniter box 200 can be arranged below the electrode chamber 400, as shown in the exemplary embodiments. In other examples, the igniter box 200 can be arranged in other positions, such as adjacent to or alongside the electrode chamber or the electrical connector 408 of the electrode chamber to facilitate the snap-fit or press-fit connection between these components. Other electrical connections can be provided to electrically connect the igniter box 200 to the electrode chamber 400.

In the embodiments described above, the home cooking appliance includes an electrode chamber 400 that is described as being mounted on or in an opening (e.g., 134 in FIG. 4) of the burner rail 130. However, other arrangements are possible within the spirit and scope of the invention so long as the burner electrode 500 can be inserted or dropped into the electrode chamber 400 to provide the electrical connection between these elements. For example, in an alternative exemplary embodiment, the home cooking appliance can include an electrode chamber 400 that is disposed under the opening (e.g., 134 in FIG. 4) in the burner rail 130 such that an end of the burner electrode 500 passes through the opening and is received by the electrode chamber 400 in the manner described above. In another alternative exemplary embodiment, the burner rail 130 also may include a separate sleeve, coating, or the like that is formed in, or on, the opening (e.g., 134 in FIG. 4) in the burner rail 130 and that is formed by an electrically non-conductive material.

Figure 16:
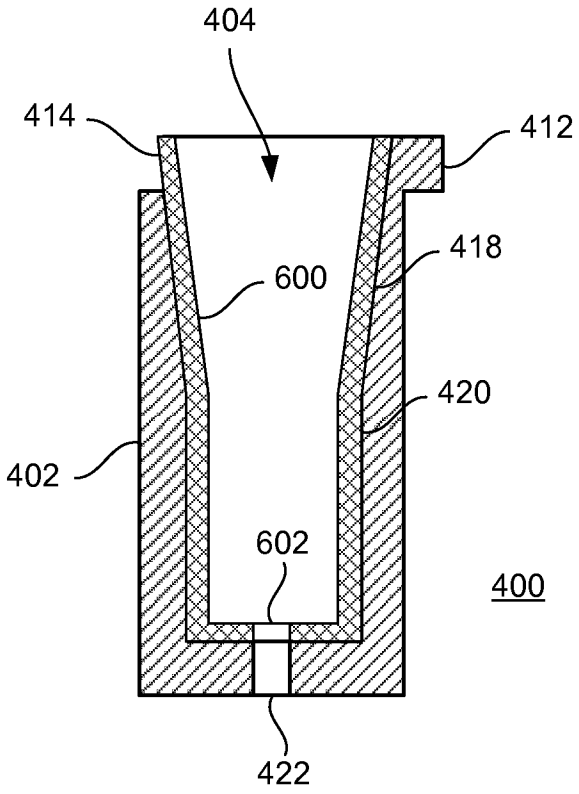
FIG. 16 is a side, cross-sectional view of a body of an electrode chamber according to another exemplary embodiment of the invention.

With reference to FIG. 16, in another exemplary embodiment, the home cooking appliance can include an electrode chamber 400 having an optional sleeve, coating, or the like (e.g., sleeve 600) formed from an electrically non-conductive material to encapsulate and insulate the end of the burner electrode 500 therein when assembled. The sleeve 600 can include an opening 602 that corresponds to the opening 422 of the electrode chamber 400. In this alternative embodiment, the body 402 of the electrode chamber 400 can be formed from any material, including an electrically conductive material, which may improve strength and durability of the electrode chamber 400.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a burner rail;

a maintop surface mounted over the burner rail;

a burner assembly mounted above the burner rail and the maintop surface, the burner assembly including a burner electrode, wherein the burner electrode is configured to be mounted from above the maintop surface, and wherein the burner electrode has a first end including an igniter disposed above the maintop surface, a second end disposed below the maintop surface, and a portion that extends from the first end above the maintop surface through the maintop surface to the second end below the maintop surface;

an igniter box disposed below the burner rail and the maintop surface; and an electrode chamber mounted on the burner rail and below the maintop surface, the electrode chamber including:

a body having a cavity and a first opening at a first end of the body for providing access to the cavity, wherein the second end of the burner electrode is disposed in the cavity;

an electrical contact surface in the cavity and configured to be engaged and electrically connected to the second end of the burner electrode; and an electrical connector at a second end of the body, the second end of the body being opposite the first end of the body, the electrical connector being electrically connected to the electrical contact surface and to the igniter box, thereby electrically connecting the igniter box to the second end of the burner electrode via the electrical connector and the electrical contact surface.

2. The home cooking appliance of claim 1, wherein the electrical connector includes an electrode or electrical fitting that is disposed at least one of at or adjacent to the second end of the body and extends from the second end of the body via a second opening in the second end of the body, wherein the electrode or electrical fitting includes a wire connector, the home cooking appliance further comprising an igniter wire connected between the wire connector and the igniter box.

3. The home cooking appliance of claim 1, wherein the electrical connector at the second end of the body is directly electrically connected to the igniter box without a wire.

4. The home cooking appliance of claim 3, wherein the electrical connector includes at least one of a snap-fit connection and a press-fit connection that is directly electrically connected to a corresponding connection of the igniter box without a wire.

5. The home cooking appliance of claim 1, further comprising: a device that biases the electrical contact surface toward the first end of the body such that the electrical contact surface exerts a force on the second end of the burner electrode received in the cavity of the body of the electrode chamber.

6. The home cooking appliance of claim 5, wherein the device includes a spring disposed in the cavity of the body between the electrical contact surface and the second end of the body.

7. The home cooking appliance of claim 1, wherein the body includes a guide that is configured to guide the second end of the burner electrode toward the electrical contact surface during the insertion of the second end of the burner electrode into the cavity.

8. The home cooking appliance of claim 1, wherein the body includes at least one of a locking feature and an aligning feature that at least one of locks and aligns, respectively, the electrode chamber with respect to a part of the burner assembly.

9. The home cooking appliance of claim 1, wherein the body is formed from an electrically non-conductive material.

10. The home cooking appliance of claim 9, wherein the body is formed from a temperature resistant material.

11. The home cooking appliance of claim 1, further comprising:

at least one of a sleeve and a coating formed from an electrically non-conductive material and disposed in the cavity.

12. The home cooking appliance of claim 11, wherein the at least one of the sleeve and the coating is formed from a temperature resistant material.

13. An electrode chamber for a burner assembly of a home cooking appliance, the electrode chamber comprising:

a body having a cavity and a first opening at a first end of the body for providing access to the cavity, wherein the body is configured to be mounted below a maintop surface of the home cooking appliance, wherein the cavity is configured to receive an end of a burner electrode of the burner assembly, wherein the burner assembly and burner electrode are mounted from above the maintop surface and wherein the burner electrode has a first end including an igniter disposed above the maintop surface, a second end disposed below the maintop surface, and a portion that extends from the first end above the maintop surface through the maintop surface to the second end below the maintop surface;

an electrical contact surface in the cavity and configured to engage and electrically connect to the second end of the burner electrode; and an electrical connector at a second end of the body, the second end of the body being opposite the first end of the body, the electrical connector being electrically connected to the electrical contact surface for electrically connecting the electrical contact surface to an igniter box and thereby being configured to electrically connect the igniter box to the second end of the burner electrode received in the cavity.

14. The electrode chamber of claim 13, wherein the electrical connector includes an electrode or electrical fitting that is disposed at least one of at or adjacent to the second end of the body.

15. The electrode chamber of claim 14, wherein the electrode or electrical fitting includes a wire connector, whereby an igniter wire of the igniter box is connected to the electrode or electrical fitting.

16. The electrode chamber of claim 14, wherein the electrode or electrical fitting extends from the second end of the body via a second opening in the second end of the body.

17. The electrode chamber of claim 14, wherein the electrical contact surface is disposed in the cavity adjacent to the second end of the body.

18. The electrode chamber of claim 13, further comprising: a device for biasing the electrical contact surface toward the first end of the body such that the electrical contact surface is configured to exert a force on the second end of the burner electrode received in the cavity.

19. The electrode chamber of claim 13, wherein the device for biasing the electrical contact surface includes a spring disposed in the cavity of the body between the electrical contact surface and the second end of the body.

20. The electrode chamber of claim 13, wherein the body includes a guide configured to guide the second end of the burner electrode toward the electrical contact surface.

21. The electrode chamber of claim 13, wherein the body includes at least one of a locking feature and an aligning feature that at least one of locks and aligns, respectively, the electrode chamber with respect to a part of the burner assembly.

22. The electrode chamber of claim 13, wherein the body includes:

a flange at the first end of the body, wherein the flange includes at least one of a locking feature and an aligning feature that at least one of locks and aligns, respectively, the electrode chamber with respect to a part of the burner assembly.

23. The electrode chamber of claim 13, wherein the body is formed from an electrically non-conductive material.

24. The electrode chamber of claim 23, wherein the body is formed from a temperature resistant material.

25. The electrode chamber of claim 13, further comprising:

at least one of a sleeve and a coating formed from an electrically non-conductive material and disposed in the cavity.

26. The electrode chamber of claim 25, wherein the at least one of the sleeve and the coating is formed from a temperature resistant material.

27. The electrode chamber of claim 13, wherein the electrical connector at the second end of the body is configured to be directly electrically connected to the igniter box without a wire.

28. The electrode chamber of claim 27, wherein the electrical connector includes at least one of a snap-fit connection and a press-fit connection that is configured to be directly electrically connected to the igniter box without a wire.

29. The home cooking appliance of claim 1, further comprising:

a resilient member disposed in the cavity of the body, wherein the resilient member biases the electrical contact surface toward the first end of the body and the maintop surface, such that the electrical contact surface exerts a force on the second end of the burner electrode received in the cavity of the body of the electrode chamber to maintain an electrical connection between the electrical contact surface and the second end of the burner electrode.

30. The home cooking appliance of claim 1, further comprising:

a spring disposed in the cavity of the body, wherein the spring biases the electrical contact surface toward the first end of the body and the maintop surface such that the electrical contact surface exerts a force on the second end of the burner electrode received in the cavity of the body of the electrode chamber to maintain an electrical connection between the electrical contact surface and the second end of the burner electrode.

31. The home cooking appliance of claim 1, wherein the second end of the burner electrode includes an electrically conductive contact surface that engages the electrical contact surface in the cavity.

32. The home cooking appliance of claim 1, wherein an outer surface of the portion of the burner electrode is an electrically non-conductive material.

* * * * *